US011358194B2

(12) United States Patent
Sano

(10) Patent No.: US 11,358,194 B2
(45) Date of Patent: Jun. 14, 2022

(54) ROLL WEAR DISPERSION METHOD FOR ROLLING STAND AND ROLLING SYSTEM

(71) Applicant: TOSHIBA MITSUBISHI-ELECTRIC INDUSTRIAL SYSTEMS CORPORATION, Chuo-ku (JP)

(72) Inventor: Mitsuhiko Sano, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 138 days.

(21) Appl. No.: 16/623,559

(22) PCT Filed: Oct. 31, 2017

(86) PCT No.: PCT/JP2017/039288
§ 371 (c)(1),
(2) Date: Dec. 17, 2019

(87) PCT Pub. No.: WO2019/087284
PCT Pub. Date: May 9, 2019

(65) Prior Publication Data

US 2021/0146415 A1 May 20, 2021

(51) Int. Cl.
*B21B 37/58* (2006.01)
*B21B 37/62* (2006.01)
*B21B 37/60* (2006.01)

(52) U.S. Cl.
CPC ..... *B21B 37/58* (2013.01); *B21B 37/62* (2013.01); *B21B 37/60* (2013.01)

(58) Field of Classification Search
CPC ..... B21B 37/58; B21B 37/60; B21B 37/62; B21B 37/66; B21B 37/68; B21B 37/28;
(Continued)

(56) References Cited

U.S. PATENT DOCUMENTS 6,119,500 A * 9/2000 Ginzburg ..... B21B 37/40 72/10.1
8,627,702 B2 * 1/2014 d'Hone ..... B21B 37/40 72/347
2007/0240475 A1 * 10/2007 Kneppe ..... B21B 37/40 72/228

FOREIGN PATENT DOCUMENTS

JP 2-179308 A 7/1990
JP 2012152819 A * 8/2012
(Continued)

OTHER PUBLICATIONS

International Search Report dated Feb. 6, 2018 in PCT/JP2017/039288 filed Oct. 31, 2017.
(Continued)

*Primary Examiner* — Teresa M Ekiert
*Assistant Examiner* — Sarkis A Aktavoukian
(74) *Attorney, Agent, or Firm* — Oblon, McClelland, Maier & Neustadt, L.L.P.

(57) ABSTRACT

When an opposite direction shift for obtaining a required equivalent roll crown and a same direction shift for wear dispersion are used in combination, a difference occurs in the roll gap at both edge portions in the width direction of a rolling target material. Therefore, the difference between a work-side screw down position and a drive-side screw down position is changed so that the roll gap difference between both the edge portions in the width direction of the rolling target material is made close to zero. As a result, the distance between the work roll shafts on a work side and a drive side is changed, so that the roll gap difference at both ends in the width direction of the rolling target material approaches zero. Therefore, the wear of the work rolls can be dispersed while maintaining the equivalent roll crown.

8 Claims, 10 Drawing Sheets

(58) Field of Classification Search
CPC ..... B21B 37/30; B21B 37/38; B21B 37/40; B21B 37/42; B21B 13/14; B21B 13/142; B21B 2269/12; B21B 2269/14; B21B 2269/02; B21B 2269/04; B21B 2267/18; B21B 29/00; B21B 31/16; B21B 31/18; B21B 31/20
See application file for complete search history.

(56) References Cited

FOREIGN PATENT DOCUMENTS

| | | | |
|---|---|---|---|
| JP | 2014-61528 | A | 4/2014 |
| JP | 2015-193037 | A | 11/2015 |
| WO | WO 2006/000290 | A1 | 1/2006 |

OTHER PUBLICATIONS

Indian Office Action dated Feb. 5, 2021 in Indian Patent Application No. 201917049785, citing documents AO and AP therein, 6 pages.

* cited by examiner

ROLL WEAR DISPERSION METHOD FOR ROLLING STAND AND ROLLING SYSTEM

FIELD

The present invention relates to a roll wear dispersion method for a rolling stand and a rolling system.

BACKGROUND

In plate rolling, plate crown and flatness are important characteristic indexes along with plate thickness, plate width, and temperature. The plate crown is a difference in plate thickness between a center and an edge portion in a plate width direction of a product (actually, a position at a predetermined distance (25 mm, 40 mm or the like) from a plate edge). The plate crown affects the dimensional accuracy of a final product when a rolling target material is shipped directly and processed by an end user. Furthermore, when the rolling target material is further worked and processed in downstream steps such as cold rolling, the plate crown also affects plate leaping performance in equipment for these steps. As described above, the plate crown affects productivity, and thus it is required to keep the plate crown within a target tolerance range.

In order to ensure that a plate is flat between rolling stands and a rolling operation can be continued stably, it is required that the difference between a crown rate on an entrance side and a crown rate on an exit side of each rolling stand is within a certain permissible range. The crown rate is the rate of the plate crown to the plate thickness of the rolling target material. When the crown rate on the exit side of a rolling stand increases beyond a certain permissible range with respect to the crown rate on the entrance side of the rolling stand, a defect in flatness of an edge expansion (edge wave) occurs. Conversely, when the crown rate on the exit side decreases beyond a certain permissible range with respect to the crown rate on the entrance side, a defect in flatness of a center expansion (center buckle) occurs. Accordingly, it is required to keep the plate crown within a target tolerance range not only at the exit side of a final rolling stand, but also between respective rolling stands of a finishing rolling mill.

In order to satisfy such requirements, a roll crown of a work roll of each rolling stand (the difference in work roll diameter between the center of the work roll in the trunk length direction and the edge portion of the work roll in the trunk length direction) is required to be set to a proper value according to a product target dimension or the like.

However, if the work roll is replaced each time the type of the material or the target dimension of products changes, the workability is greatly deteriorated. Therefore, there are widely used rolling equipment configured so that an upper work roll and a lower work roll which are ground so that work roll diameter distributions thereof have cubic-curve shapes as shown in (B) of FIG. 1 are arranged so as to face each other, and the upper work roll and the lower work roll are moved in opposite directions in the trunk length direction (opposite direction shift), thereby changing equivalent roll crown (called equivalent roll crown because the same effect as if initial grinding crown was given to the work roll is obtained by the opposite direction shift).

FIG. 5 shows an example of the work roll diameter distribution, FIG. 6 shows a change characteristic of the equivalent roll crown when the upper work roll and the lower work roll are shifted in the opposite directions. Furthermore, there is a case where a pair of work rolls which are ground so as to be represented by curves asymmetric with respect to the center of the trunk length, such as a higher order function or a trigonometric function, instead of the cubic curves is used. Hereinafter, a roll having a curved work roll diameter distribution as described above is referred to a curve roll, and rolling equipment configured to change the equivalent roll crown by shifting the curve rolls in vertically opposite directions is referred to as a crown-variable rolling mill.

Such a crown-variable rolling mill has a problem that the work roll is locally worn and the life thereof may be shorter than an original service life limit. In other words, when a large number of products (coils) having substantially the same target dimensions (thickness, width, plate crown) are continuously rolled, a portion of the work roll which comes into contact with an edge portion in the width direction of a rolling target material (generally, the edge portion is low in temperature and hard) is remarkably unevenly worn as shown in FIG. 7. For a subsequent rolling target material, the uneven wear of the edge portion of the plate width is transferred to the rolling target material, and a defect (called Cat ear) in which the edge portion of the rolling target material becomes thick occurs. The rolling target material in which Cat ear has occurred is highly likely to cause serious plate leaping troubles in the downstream steps. Accordingly, when such a defect occurs, it is necessary to replace the work roll, which is a factor for deteriorating the operation efficiency.

As a countermeasure against this, there is widely used a wear dispersion method in which the opposite direction shift is periodically changed so that a contact position with the edge portion of the rolling target material does not concentrate. In this way, the position at which the work roll comes into contact with the edge portion in the width direction of the rolling target material changes in the trunk length direction of the work roll. Therefore, wear is dispersed, uneven wear such as Cat ear is reduced, a defect is less likely to occur, and the replacement frequency of the work roll can be reduced.

However, in the case of use of the curve roll, when the opposite direction shift is changed for wear dispersion, it causes the equivalent roll crown to change from an originally required value. In such a case, the crown rate on the exit side of the rolling stand greatly changes with respect to the crown rate on the entrance side of the rolling stand, so that the flatness of the rolling target material may be deteriorated.

Therefore, a method of increasing or decreasing work roll bending force so as to offset the change of the equivalent roll crown caused by wear dispersion has been conventionally proposed. In other words, when the opposite direction shift is moved in a direction of increasing the equivalent roll crown due to wear dispersion, an operation of decreasing a bender load of the rolling stand so as to offset the equivalent roll crown is performed. Conversely, when the opposite direction shift is moved in a direction of decreasing the equivalent roll crown due to wear dispersion, an operation of increasing the bender load of the rolling stand so as to offset the equivalent roll crown is performed.

Such a conventional wear dispersion method is disclosed in Patent Literature 1, for example. Furthermore, a rolling method of applying the same content to a six-stage rolling mill is disclosed in Patent Literature 2.

CITATION LIST

Patent Literature

[PTL 1] JP H2-179308 A
[PTL 2] International Publication No. WO2006/000290

SUMMARY

Technical Problem

However, as described above, the wear dispersion method based on the opposite direction shift has the following problems.

(1) It is necessary that the opposite direction shift amount for wear dispersion is limited to a range that can be offset by the work roll bender, and a sufficient wear dispersion effect may not always be obtained.

(2) Since the bender load is changed to compensate for wear dispersion, the substantial variable range of the bender load in a coil being rolled is narrowed. Therefore, compensation by bender control cannot be sufficiently performed for the change of the work roll crown caused by thermal expansion of the work roll due to heat input from the rolling target material and fluctuation in the rolling load caused by uneven increase in temperature of the rolling target material, so that defects in the plate crown and flatness are likely to occur. Particularly, in semi-endless rolling for rolling a single elongated slab and then cutting it into parts to obtain a plurality of coil products, or in endless rolling for rolling a slab under casting as it is in a continuous casting apparatus and then cutting it into parts to obtain a plurality of coil products, the heat input from the rolling target material continues for a long time and thus the thermal expansion of the work roll is remarkable, so that these defects are likely to occur.

The present invention has been made to solve the above-described problems, and has an object to provide a roll wear dispersion method for a rolling stand and a rolling system that are capable of dispersing wear of work rolls while maintaining an equivalent roll crown.

Solution to Problem

In order to achieve the above object, a roll wear dispersion method for a rolling stand according to the present invention is configured as follows.

The rolling stand comprises a pair of work rolls, a work roll shift device, and a roll gap adjusting device. The pair of work rolls are configured so that an upper work roll and a lower work roll ground so that roll diameter distributions thereof in an axial direction are expressed by cubic or higher-order polynomials (curves which are bilaterally asymmetric with respect to the center of the trunk length (barrel length)) are opposed to each other. The upper work roll and the lower work roll are charged in opposite directions with respect to the axial direction. Furthermore, the cubic or higher-order polynomials include a trigonometric function that can be approximated with a polynomial by Taylor expansion. The work roll shift device shifts each of the upper work roll and the lower work roll in the axial direction. In other words, the upper work roll and the lower work roll can be independently shifted in parallel in the opposite directions and in the same direction. The roll gap adjusting device changes a work-side roll gap and a drive-side roll gap of the pair of work rolls by changing a work-side screw down position and a drive-side screw down position.

In the roll wear dispersion method, first, an opposite direction shift amount for the upper work roll and the lower work roll is calculated with a plate crown and flatness of the rolling target material on an exit side of the rolling stand being within permissible ranges. Secondly, a same direction shift amount for the upper work roll and the lower work roll that disperses the wear of the pair of work rolls is calculated. Thirdly, a screw down position difference of the roll gap adjusting device that makes a roll gap difference between both edge portions in a width direction of the rolling target material close to zero is calculated based on the same direction shift amount. The screw down position difference is a difference between the work-side screw down position and the drive-side screw down position of the roll gap adjusting device. Fourthly, the work roll shift device is caused to shift each of the upper work roll and the lower work roll based on a total value of the opposite direction shift amount and the same direction shift amount, and the roll gap adjusting device is caused to change the work-side screw down position and the drive-side screw down position based on the screw down position difference.

As described above, when the opposite direction shift for obtaining the required equivalent roll crown ((B) of FIG. 1) and the same direction shift for wear dispersion ((C) of FIG. 1) are used in combination, as indicated by arrows 15 and 16 in (D) of FIG. 2, a difference occurs between the roll gaps at both the edge portions in the width direction of the rolling target material 20. Therefore, in the present invention, the difference (leveling) between the work-side screw down position and the drive-side screw down position is changed so as to make the roll gap difference between the edge portions in the width direction of the rolling target material 20 close to zero. As a result, as shown in (E) of FIG. 2, the distance between the work-side and drive-side work roll shafts is changed, so that the roll gap difference between both the ends in the width direction of the rolling target material 20 is made close to zero. Therefore, the wear of the work rolls can be dispersed while maintaining the equivalent roll crown.

Furthermore, in order to achieve the above object, a rolling system according to the present invention is configured as follows.

A rolling system for rolling a rolling target material comprises a pair of work rolls, a work roll shift device, a roll gap adjusting device, an opposite direction shift amount calculator, a same direction shift amount calculator, a screw down position difference calculator, and a controller. The pair of work rolls are configured so that an upper work roll and a lower work roll ground so that roll diameter distributions thereof in an axial direction are expressed by cubic or higher-order polynomials are opposed to each other. The work roll shift device shifts each of the upper work roll and the lower work roll in the axial direction. The roll gap adjusting device changes a work-side roll gap and a drive-side roll gap of the pair of work rolls by changing a work-side screw down position and a drive-side screw down position. The opposite direction shift amount calculator calculates an opposite direction shift amount for the upper work roll and the lower work roll with a plate crown and flatness of the rolling target material on an exit side of the pair of work rolls being within permissible ranges. The same direction shift amount calculator calculates a same direction shift amount for the upper work roll and the lower work roll that disperses wear of the pair of work rolls. The screw down position difference calculator calculates, based on the same direction shift amount, a screw down position difference of the roll gap adjusting device that makes a roll gap difference between both edge portions in a width direction of the rolling target material close to zero. The controller causes the work roll shift device to shift each of the upper work roll and the lower work roll based on a total value of the opposite direction shift amount and the same direction shift amount, and causes the roll gap adjusting device to change the work-side screw down position and the drive-side screw down position based on the screw down position difference.

Advantageous Effects of Invention

According to the present invention, (1) the same direction shift amount for wear dispersion is not restricted by a bender load variable range, and therefore a sufficient wear dispersion effect can be obtained. (2) Since compensation of wear dispersion by the bender can be reduced, compensation by bender control can be performed to the maximum for thermal expansion of the work roll and load fluctuation during rolling, and defects of the plate crown and the flatness can be reduced. In particular, the present invention is effective to improvement of productivity in semi-endless rolling and endless rolling. According to the present invention, the wear of the work rolls can be dispersed while maintaining the equivalent roll crown.

DESCRIPTION OF EMBODIMENTS

Hereinafter, embodiments of the present invention will be described in detail with reference to the drawings. Note that common elements in respective figures are represented by the same signs, and duplicative description thereof is omitted.

First Embodiment (Rolling System)

Figure 3:
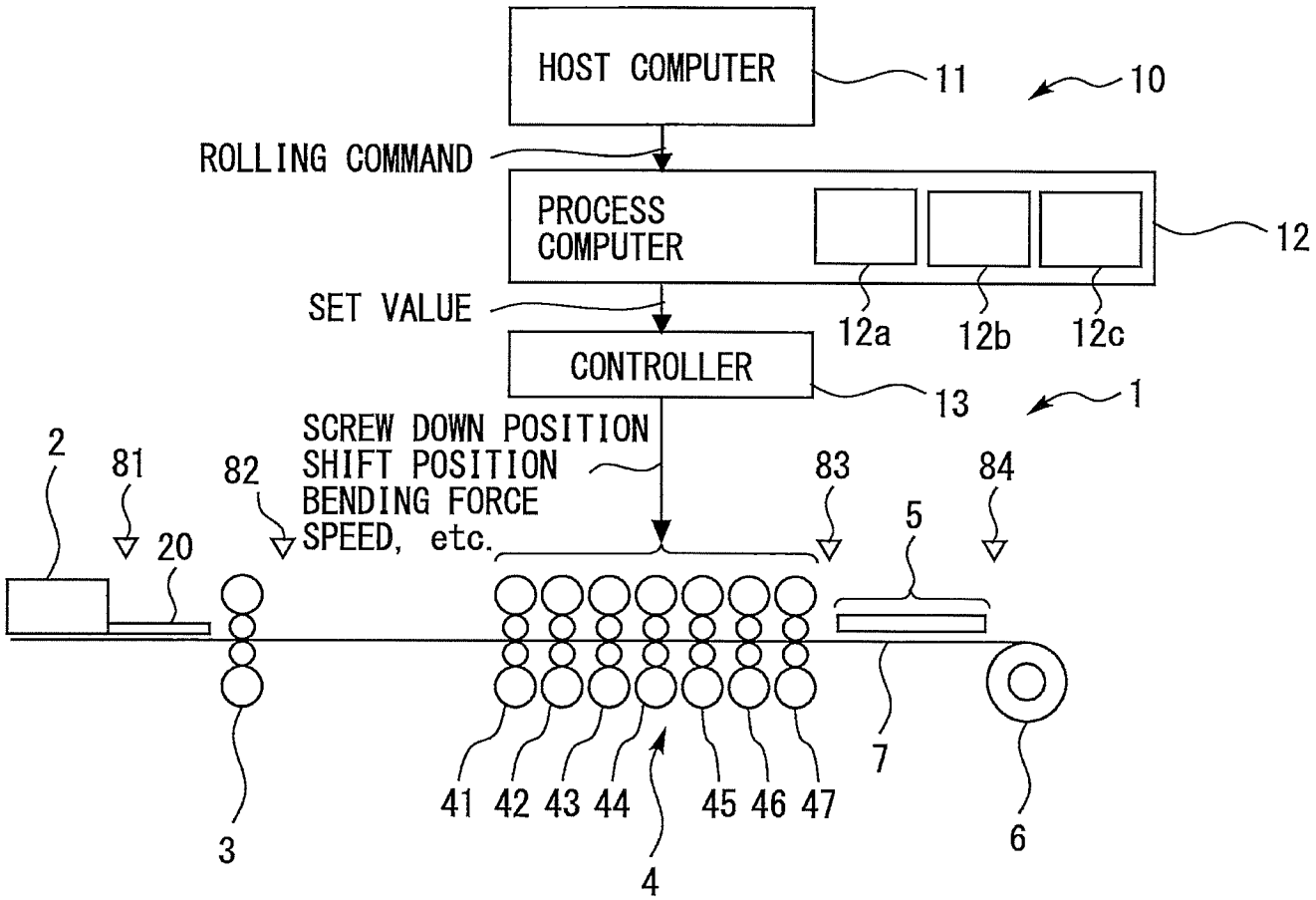
FIG. 3 is a schematic diagram showing a configuration example of a rolling system according to a first embodiment.

A rolling system according to a first embodiment includes a single rolling stand or a plurality of rolling stands, and rolls steel or other metal materials into a plate shape by hot rolling or cold rolling. FIG. 3 is a schematic diagram showing a configuration example of the rolling system according to the first embodiment. In a hot rolling line shown in FIG. 3, the semi-endless rolling or endless rolling described above is performed, for example. Note that the present invention is also applicable to a cold rolling line.

In FIG. 3, a rolling target material 20 of a metal material is thinly stretched while being processed in a hot rolling line, and the size and temperature of the material are controlled to desired target values. Rolling equipment 1 includes a heating furnace 2, a rough rolling mill 3, a finishing rolling mill 4, a runout table 5, a coiler 6, and a roller table 7 for conveying the rolling target material 20 among them.

The heating furnace 2 increases the temperature of the rolling target material 20. The rolling target material 20 whose temperature has been increased is extracted onto the roller table 7. When leaving the heating furnace 2, the rolling target material 20 is a molded lump of metal called a slab.

The rough rolling mill 3 is provided downstream of the heating furnace 2. The rough rolling mill 3 includes a single rolling stand or a plurality of rolling stands. The rough rolling mill 3 rolls the rolling target material 20 at a plurality of times in a forward direction (from upstream to downstream) and in a reverse direction (from downstream to upstream). The rolling target material 20 is rolled up to a thickness of about several tens of millimeters.

Figure 1:
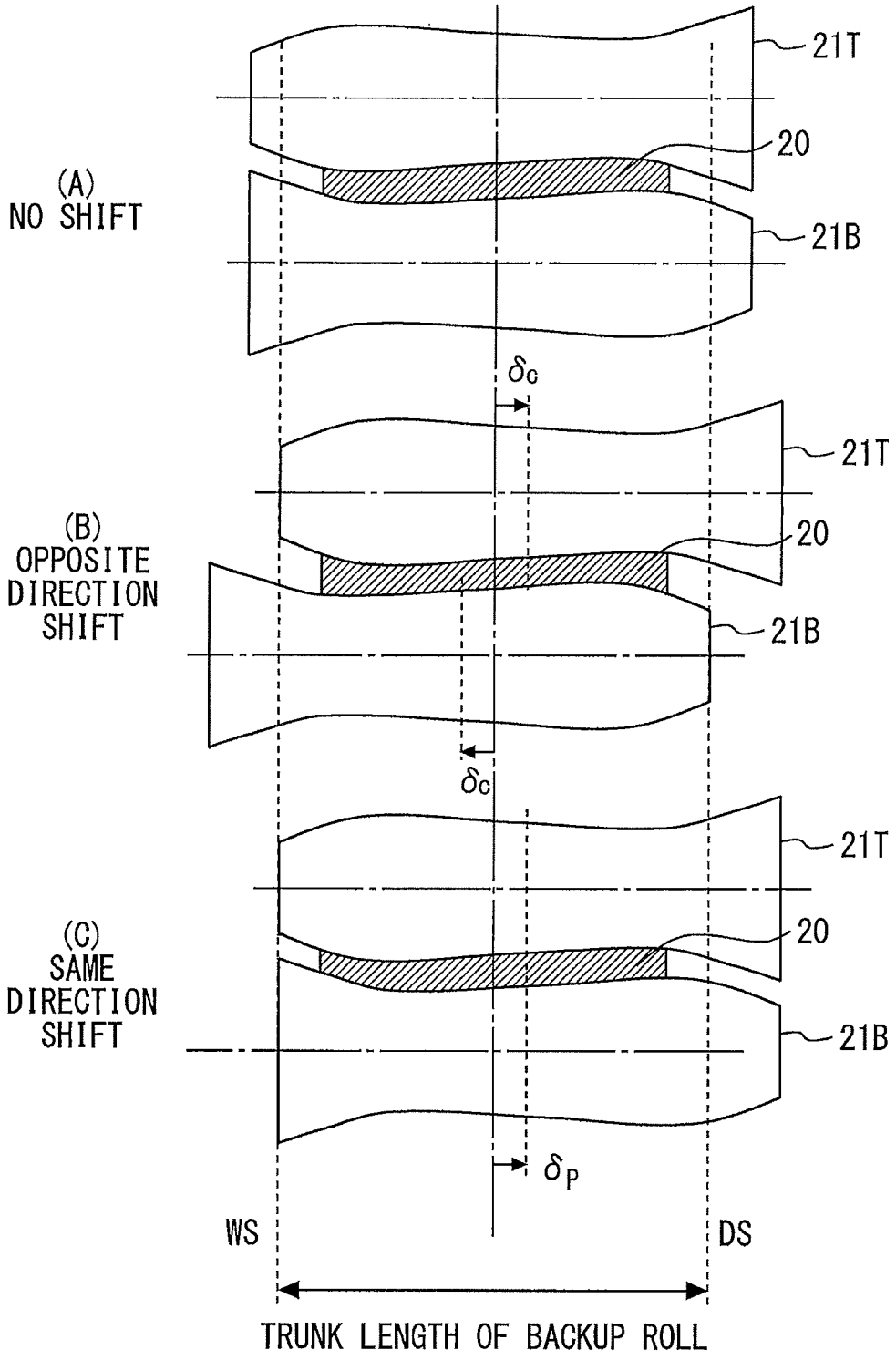
FIG. 1 is a diagram for explaining opposite direction shift and same direction shift of a work roll.
Figure 2:
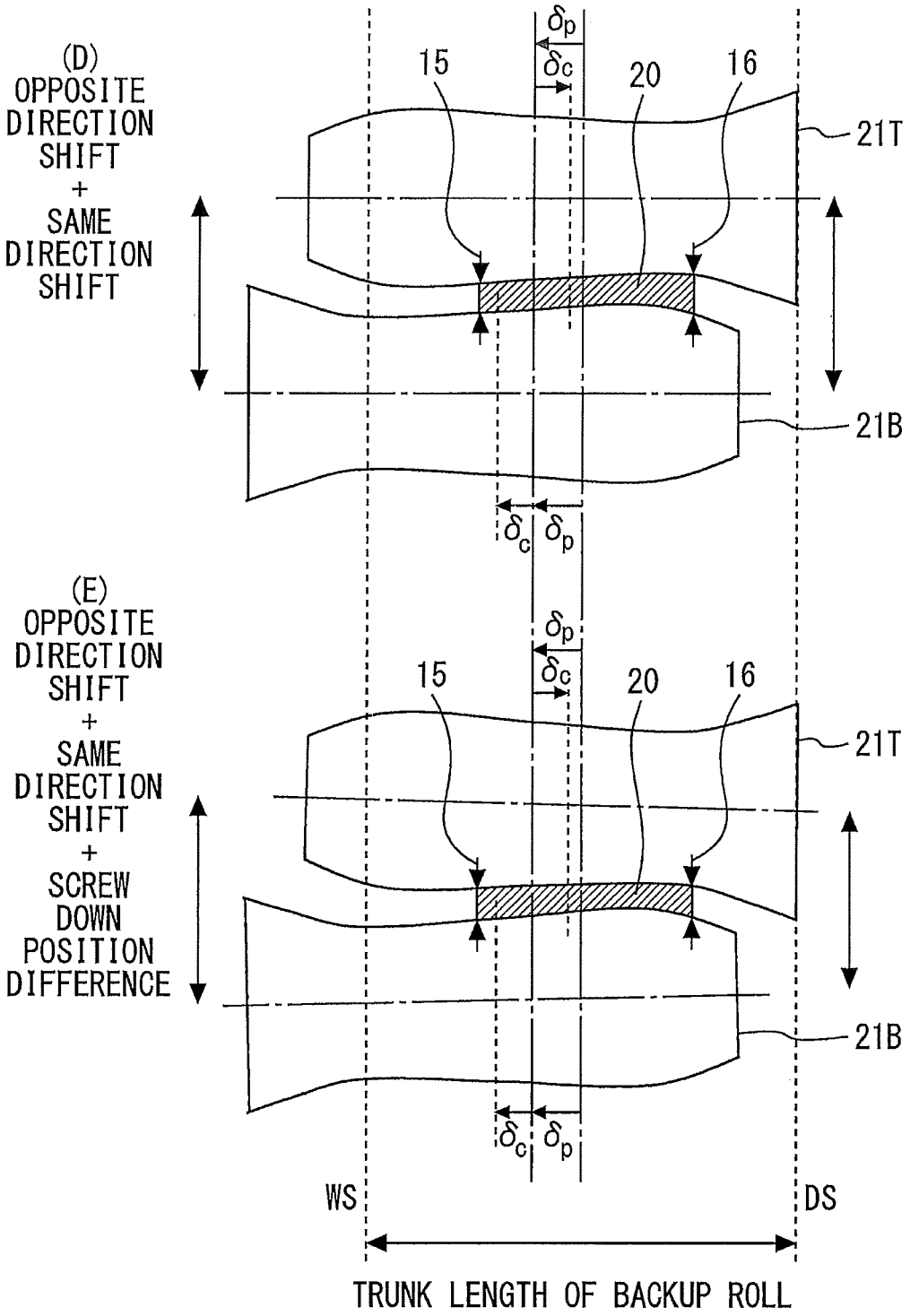
FIG. 2 is a diagram for explaining the opposite direction shift and the same direction shift of the work roll.

The finishing rolling mill 4 is provided downstream of the rough rolling mill 3. The finishing rolling mill 4 includes a plurality of rolling stands, and rolls the rolling target material 20 in one direction from upstream to downstream. FIG. 1 depicts seven rolling stands (41 to 47), but the number of rolling stands is not limited to this value. Final quality related to the size such as the plate size, plate width, etc. of the rolling target material 20 is determined by finishing rolling.

The runout table 5 is provided downstream of the finishing rolling mill 4. A cooling device for pouring water into the rolled rolling target material 20 is installed in the runout table 5. The rolling target material 20 is cooled to a target temperature by the cooling device.

The coiler 6 is provided downstream of the runout table 5. The rolling target material 20 cooled on the runout table 5 is wound around the coiler 6 to be formed into a coiled product while being guided downward by a pinch roll.

Various sensors 81 to 84 such as a radiation thermometer, and an X-ray plate thickness gauge are installed at important places of the rolling equipment 1 (an exit side of the heating furnace 2, an exit side of the rough rolling mill 3, an exit side of the finishing rolling mill 4, an entrance side of the coiler 6, etc.). A load cell (not shown) is installed in each rolling stand. These sensors sequentially measure the state (plate thickness, temperature, rolling load, etc.) of the rolling target material 20 and each device.

The rolling equipment 1 is controlled by control equipment 10 using a computer. The control equipment 10 includes a host computer 11, a process computer 12, and a controller 13.

Based on a rolling plan for a plurality of rolling target materials 20, the host computer 11 transmits rolling commands for a target dimension (thickness, width, plate crown) of each rolling target material 20 and target temperature (temperature on the exit side of the finishing rolling mill, temperature on the entrance side of the coiler, etc.) to the process computer 12.

When the rolling target material 20 is extracted from the heating furnace 2, the process computer 12 calculates a set value for each device of the rolling equipment 1 according to the rolling commands received from the host computer 11, and transmits the set value to the controller 13. This set value includes a screw down position of a roll gap adjusting device described later, a roll rotation speed, bending force, and a work roll shift amount, etc.

When the rolling target material 20 is conveyed to a predetermined position in front of each device, the controller 13 operates an actuator of each device based on the set value. Furthermore, when rolling is started, the controller 13 sequentially operates each actuator based on the measurement values obtained by the sensors such as the radiation thermometer, the X-ray plate thickness gauge, and the load cell described above so that the target dimension of the rolling target material 20, the target temperature, etc. are matched with the rolling commands.

Setting calculation in the process computer 12 is calculation of numerical values by mathematically modeling theoretically calculable parts of set specifications of the rolling mill. As an example, an opposite direction shift amount calculator 12*a* calculates an opposite direction shift amount of each rolling stand of the finishing rolling mill 4 by a mathematical model according to a rolling command so as to obtain a desired target crown. This mathematical model is represented by a mathematical expression having parameters such as the crown on the entrance side, a rolling load, and a roll crown of each rolling stand, for example, simultaneous inequalities like the following expressions. Various methods are known for this numerical solution, and the details are omitted.

(i) Exit-Side Crown Formula

[Expression 1]

$$C_1=k_1\times C_0+k_2\times P+k_3\times C_{eq}+k_4\times F_B \quad (1)$$

Here, $C_1$ represents the plate crown on the exit side of the rolling stand, $C_0$ represents the plate crown on the entrance side of the rolling stand, P represents the rolling load of the rolling stand, $F_B$ represents the work roll bending force of the rolling stand, and $C_{eq}$ represents the equivalent roll crown of the rolling stand. The influence coefficients $k_1$, $k_2$, $k_3$, and $k_4$ are expressed by functions of the plate thickness, the plate width, the roll diameter, etc. Note that when the rolling stand is a first rolling stand 41, $C_0$ is calculated based on a rolling condition of the rough rolling mill 3. In addition, when the rolling stand is a final rolling stand 47, $C_1$ is given as a target crown of a product.

(ii) Flatness Permissible Range Formula

[Expression 2]

$$\varepsilon\leq|C_1/h_1-C_0/h_0| \quad (2)$$

Here, $C_1$ represents the plate crown on the exit side of the rolling stand, $C_0$ represents the plate crown on the entrance side of the rolling stand, $h_1$ represents the plate thickness on the exit side of the rolling stand, and $h_0$ represents the plate thickness on the entrance side of the rolling stand. Furthermore, the flatness permissible range parameter ε is expressed by functions including the type of steel, the plate thickness, the plate width, etc. Generally, the value of ε becomes smaller as the plate thickness is smaller.

(iii) Calculation Formula of Opposite Direction Shift Amount

[Expression 3]

$$\delta_C=k_A+k_B\times C_{eq} \quad (3)$$

Here, $\delta_c$ represents the opposite direction shift amount, and $k_A$ and $k_B$ represent influence coefficients determined by a curve indicating a roll diameter distribution. For example, the following expression obtained by modifying the expression (14) described later can be used.

[Expression 4]

$$\delta_C=(C_2-4\times C_{eq}/L_B^2)/(3\times C_3) \quad (4)$$

Here, $C_2$ and $C_3$ represent coefficients of a cubic curve indicating a roll diameter distribution, and $L_B$ represents the trunk length (barrel length) of a backup roll.

(Roll Wear Dispersion Method)

Next, a roll wear dispersion method for a rolling stand will be described.

Figure 4:
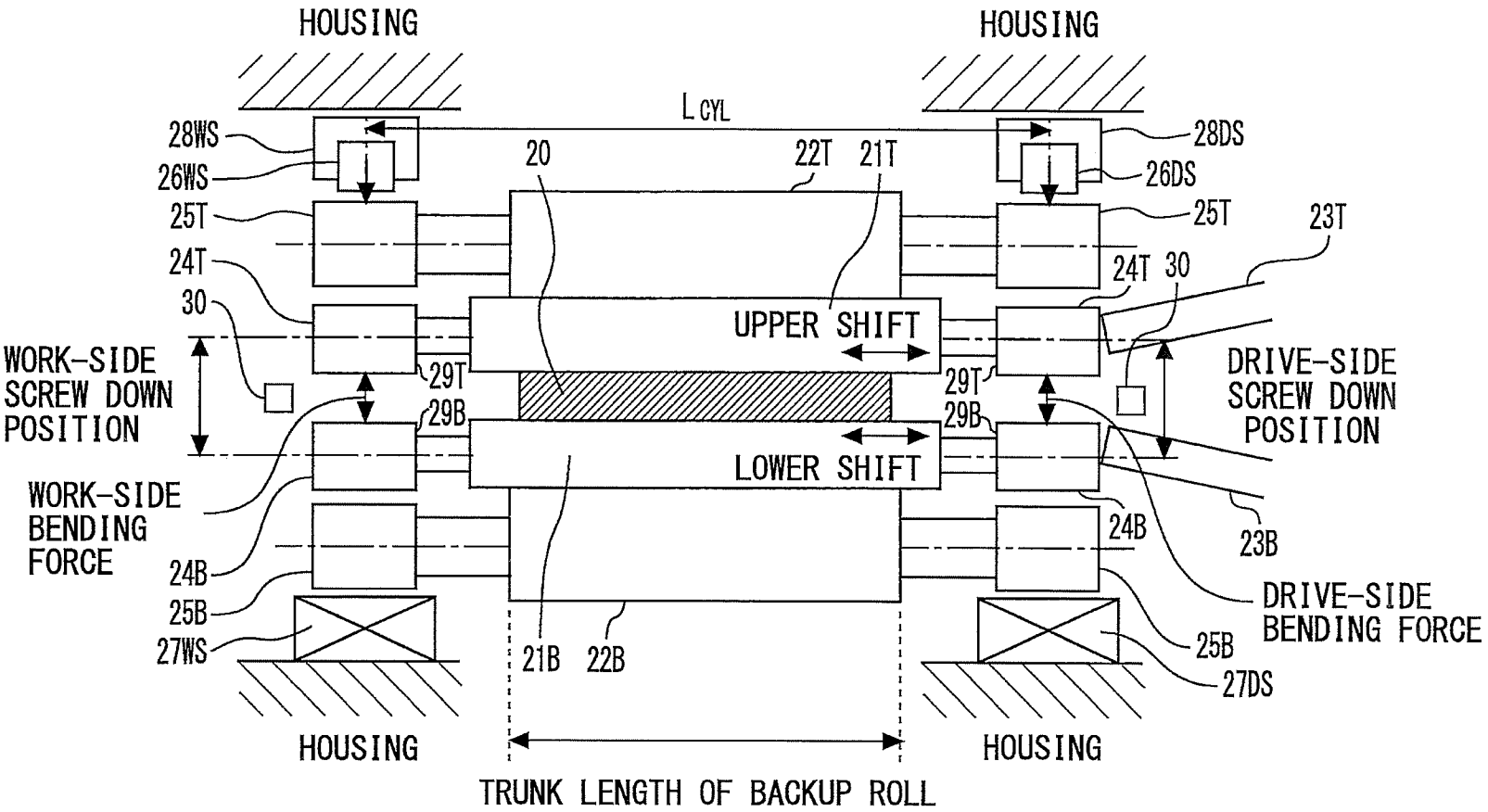
FIG. 4 is a schematic view showing a configuration example of each rolling stand.
Figure 5:
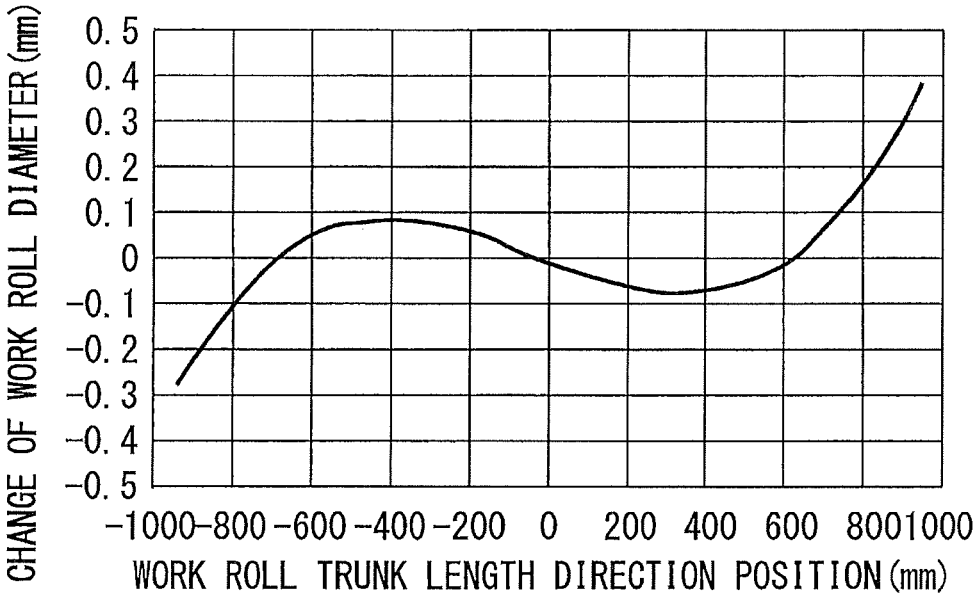
FIG. 5 is a diagram showing an example of a work roll diameter distribution.
Figure 6:
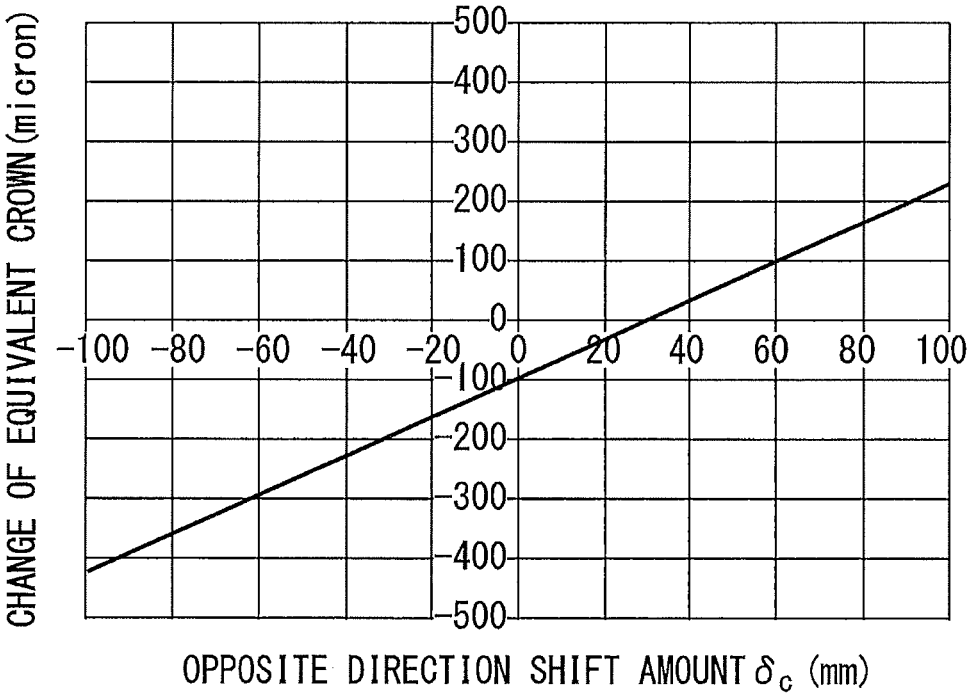
FIG. 6 is a diagram showing a change characteristic of an equivalent roll crown when upper and lower work rolls are shifted in opposite directions.
Figure 7:
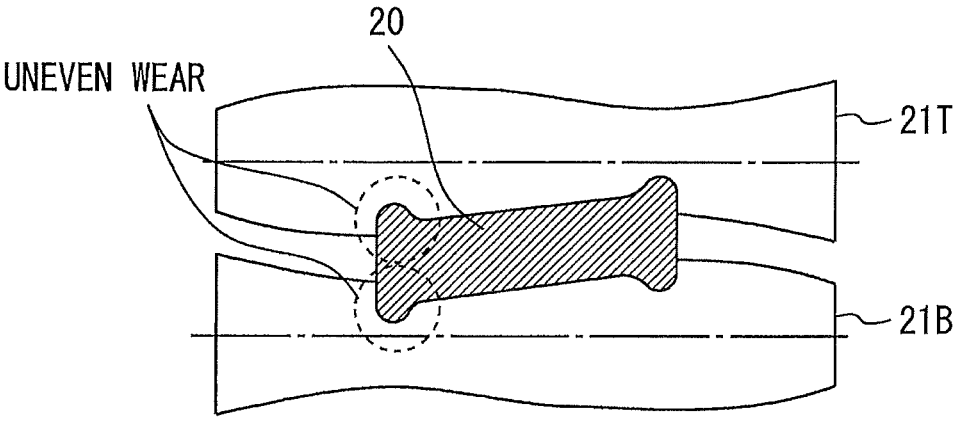
FIG. 7 is a diagram for explaining uneven wear of the upper and lower work rolls.

FIG. 4 is a schematic diagram showing a configuration example of each rolling stand. A pair of work rolls for applying deformation to the rolling target material 20 are configured so that an upper work roll 21T and a lower work roll 21B are opposed to each other, the upper work roll 21T and the lower work roll 21B being ground so that roll diameter distributions thereof in an axial direction are expressed by cubic or higher-order polynomials. The upper work roll 21T and the lower work roll 21B are arranged point-symmetrically with respect to the rolling target material 20. At least a pair of backup rolls (upper backup roll 22T, lower backup roll 22B) for supporting the pair of work rolls to suppress the pair of the work rolls from sagging are arranged vertically with the pair of the work rolls interposed therebetween. Note that the present invention can also be applied to a rolling stand having a pair of intermediate rolls between a backup roll and a work roll. A gap between the upper work roll 21T and the lower work roll 21B is referred to as a roll gap. The pair of work rolls are also referred to as upper and lower work rolls, and the pair of backup rolls are also referred to as upper and lower backup rolls.

A drive shaft (upper spindle 23T) is attached to one side of the upper work roll 21T via a universal joint. A drive shaft (lower spindle 23B) is attached to one side of the lower work roll 21B via a universal joint. Each spindle is rotationally driven by a main motor (not shown) via a speed reducer. Note that in the rolling mill, a side to which the spindle is connected is called a drive side (DS), and an opposite side to the drive side is called a work side (WS).

Both ends of the upper work roll 21T are fitted into shaft boxes (upper work roll chocks 24T) via bearings. Both ends of the lower work roll 21B are fitted into shaft boxes (lower work roll chocks 24B) via bearings. Likewise, both ends of the upper backup roll 22T are fitted into shaft boxes (upper backup roll chocks 25T) via bearings. Both ends of the lower backup roll 22B are fitted into shaft boxes (lower backup roll chocks 25B) via bearings.

Roll gap adjusting devices (work-side roll gap adjusting device 26WS, drive-side roll gap adjusting device 26DS) are provided between a structure (housing) of the rolling stand and the upper backup roll chocks 25T on both sides. The work-side roll gap adjusting device 26WS and the drive-side roll gap adjusting device 26DS can be driven independently of each other, and can be screwed down in the vertical direction to change the distance between the shafts of the upper and lower backup rolls. In FIG. 4, the roll gap adjusting devices are provided above the rolling stand, but they may be provided below the rolling stand or may be provided both above and below the rolling stand. These roll gap adjusting devices include hydraulic cylinders. For high responsiveness, it is preferable that the length of the hydraulic cylinder is short. Therefore, a configuration obtained by combining a hydraulic cylinder capable of controlling the screw down position with high responsiveness and an electric screw mechanism capable of greatly changing the screw down position is preferable. A step edge may be used instead of the electric screw mechanism.

Load detectors (work-side load cell 27WS, drive-side load cell 27DS) are mounted between the housing of the rolling stand and the lower backup roll chocks 25B on both sides. The load detector may be mounted between the roll gap adjusting device and the upper backup roll chock 25T.

A work-side position detector 28WS is attached to the work-side roll gap adjusting device 26WS, and a drive-side position detector 28DS is attached to the drive-side roll gap adjusting device 26DS to detect a screw down position. The screw down position is the piston position of the hydraulic cylinder of the roll gap adjusting device. A work-side screw down position detected by the work-side position detector 28WS correlates with the roll gap between the upper and lower work rolls on the work side. A drive-side screw down position detected by the drive-side position detector 28DS correlates with the roll gap between the upper and lower work rolls on the drive side. The roll gap adjusting devices change the work-side roll gap and the drive-side roll gap of the pair of work rolls by changing the work-side screw down position and the drive-side screw down position.

When the work roll is replaced, a zero point adjustment of the screw down position is performed. In this zero point adjustment, each roll gap adjusting device is first operated to reduce the distance between the shafts. When the upper and lower work rolls eventually come into contact with each other, the contact load is detected by each load detector. When the distance between the shafts is further reduced, the contact load increases. At this time, if there is any difference in the contact load between the work side and the drive side, the distance between the shafts is adjusted on both the work side and the drive side so that the difference in the load is reduced. When the contact load has reached a predetermined value (for example, totally, 10000 kN), that point is set as a zero point of the screw down position. Hereinafter, the change of the distance between the shafts from the zero point will be referred to as a work-side screw down position $S_{WS}$ and a drive-side screw down position $S_{DS}$. Furthermore, the average of both the sides is set as a center screw down position $S=(S_{WS}+S_{DS})/2$. With respect to these screw down positions, a direction in which the roll gap is opened is defined as a positive direction.

The upper work roll chock 24T includes an upper work roll shift device 29T for shifting the upper work roll 21T in the axial direction by a hydraulic cylinder or the like. The lower work roll chock 24B includes a lower work roll shift device 29B for shifting the lower work roll 21B in the axial direction by a hydraulic cylinder or the like. Here, a position where the center of the trunk length portion of each work roll coincides with the center in the width direction of the rolling mill is set as an origin, and a moving distance in a direction to the drive side is defined as an upper work roll shift amount $\delta_T$ and a lower work roll shift amount $\delta_B$.

Work roll benders 30 each having hydraulic cylinder which apply bending force to both the shaft ends of the upper and lower work rolls are provided between the upper work roll chock 24T and the lower work roll chock 24B. This bending force $F_B$ is equal to the total of the hydraulic cylinder loads of the work roll benders 30 on the work side and the drive side.

The upper and lower work rolls are ground so that the roll diameter distributions in the axial direction are expressed by cubic or higher-order polynomials or approximate expressions thereof, and the upper work roll 21T and the lower work roll 21B are charged in opposite directions to each other with respect to the axial direction.

For example, when the roll diameter distribution in the axial direction is given by a cubic function, the roll diameter distributions (diameters) of the upper and lower work rolls are expressed by the following expressions. Note that the center position in the width direction of the rolling mill is set as an origin, and the distance from the origin in a direction to the drive side is defined as a position x in the width direction. $C_0$, $C_1$ and $C_2$ represent coefficients of the cubic function.

[Expression 5]

$$D_{WT}(x)=C_0+C_1\times(x-\delta_T)+C_2\times(x-\delta_T)^2+C_3x(x-\delta_T)^3 \quad (5)$$

[Expression 6]

$$D_{WB}(x)=C_0-C_1\times(x-\delta_B)+C_2\times(x-\delta_B)^2-C_3\times(x-\delta_B)^3 \quad (6)$$

Here, a same direction shift amount $\delta_P$ (a shift amount by which the upper work roll 21T and the lower work roll 21B are shifted in the same direction), and an opposite direction shift amount $\delta_C$ (a shift amount by which the upper work roll 21T and the lower work roll 21B are shifted in opposite directions) are introduced. These are defined as follows by using $\delta_B$ and $\delta_T$.

[Expression 7]

$$\delta_P=(\delta_T+\delta_B)/2 \quad (7)$$

[Expression 8]

$$\delta_C=(\delta_T-\delta_B)/2 \quad (8)$$

On the other hand, in the case where the screw down positions of the work side and drive side are different from each other, when the interval between action points of the roll gap adjusting devices is represented by $L_{CYL}$ (see FIG. 4), the screw down position at each position in the width direction is expressed by the following expression by proportional division for both the work side and the drive side.

[Expression 9]

$$S(x)=(S_{DS}+S_{WS})/2+(x/L_{CYL})\times(S_{DS}-S_{WS}) \quad (9)$$

Here, a screw down position difference $\delta_S$ is introduced. The screw down position difference is also called a leveling amount.

[Expression 10]

$$\delta_S=\delta_{DS}-\delta_{WS} \quad (10)$$

The roll gap decreases as the work roll diameter and the backup roll diameter increase, and increases as the screw down position increases. Therefore, assuming that the roll diameter of the backup roll is constant and also rigidity is sufficiently high, so that neither sagging nor flattening occurs, the deviation y (x) of the roll gap at each position in the width direction with respect to the roll gap at the center in the width direction is expressed by the following expression.

[Expression 11]

$$y(x)=(S(x)-S(0))-(D_{WT}(x)-D_{WT}(0))-(D_{WB}(x)-D_{WB}(0)) \quad (11)$$

By substituting Expressions (5), (6), (7), (8), (9), and (10) into Expression (11), the following expression is achieved.

[Expression 12]

$$y(x)=(x/L_{CYL}))\times\delta_S-(2\times C_2-6\times C_3\times\delta_C)\times x^2-(-4\times C_2+12\times C_3\times\delta_C)\times\delta P\times x \quad (12)$$

Here, when y in the case where wear dispersion is not performed is represented by $y_0$, $y_0(x)$ is expressed by the following expression because $\delta_P=0$ and $\delta_S=0$. A roll gap with a parabolic distribution is obtained.

[Expression 13]

$$y_0(x)=-(2\times C_2-6\times C_3\times\delta_C)\times x^2 \quad (13)$$

An equivalent roll crown $C_{eq}$ per roll at a backup roll end position at this time is expressed by the following expression, where the trunk length of the backup roll is represented by $L_B$.

[Expression 14]

$$\begin{aligned} C_{eq} &= -y_0\times(L_B/2)/2 \\ &= (C_2-3\times C_3\times\delta_c)/4\times L_B^2 \end{aligned} \quad (14)$$

When the wear dispersion according to the present invention is applied, $\delta_C$, $\delta_P$ and $\delta_S$ are calculated so that y (x) is equivalent to $y_0(x)$ in setting calculation of a process computer 12 as shown below. Based on these values, the controller 13 operates the work roll shift devices (29T, 29B) and the roll gap adjusting devices (26WS, 26DS).

(Processing Flow)

Figure 8:
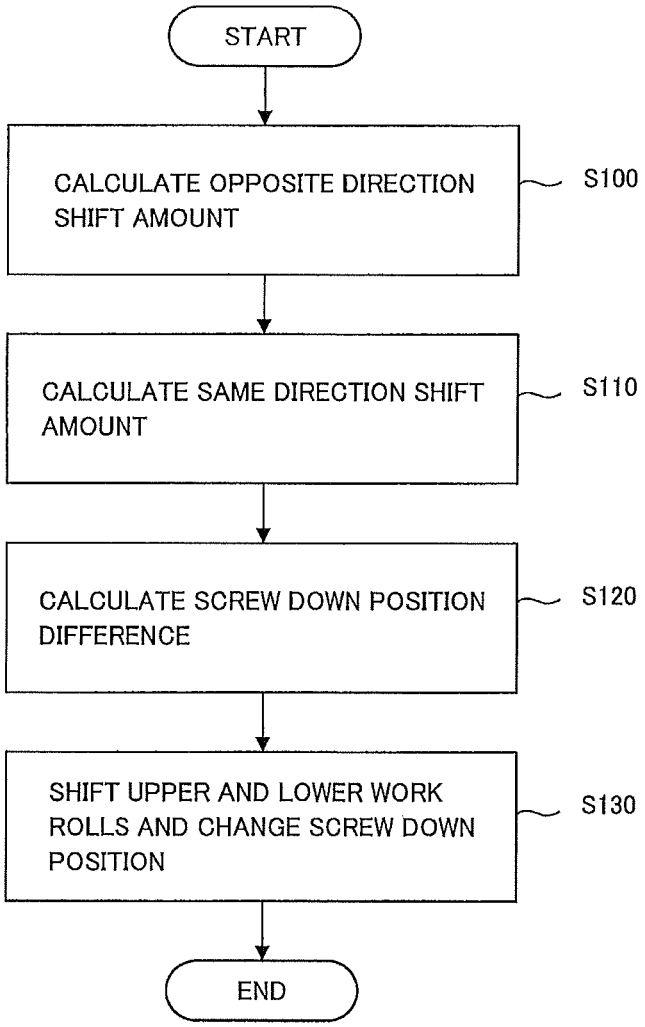
FIG. 8 is a flowchart of processing executed every control cycle in control equipment according to the first embodiment.

FIG. 8 is a flowchart of processing to be executed at each predetermined control cycle in the control equipment 10 according to the first embodiment. The setting calculation of the process computer 12 is executed in accordance with the rolling command received from the host computer 11.

First, in step S100, the opposite direction shift amount calculator 12*a* calculates the opposite direction shift amount for the upper work roll 21T and the lower work roll 21B with the plate crown and flatness of the rolling target material 20 on the exit side of the rolling stand being within permissible ranges. Specifically, the opposite direction shift amount calculator 12*a* calculates the opposite direction shift amount $\delta_C$ according to the expression (4) so as to obtain a target exit side crown.

Next, in step S110, the same direction shift amount calculator 12*b* calculates the same direction shift amount for the upper work roll 21T and the lower work roll 21B that disperse the wear of the pair of work rolls. The same method as a wear dispersion method based on the opposite direction shift which has been conventionally applied for work rolls whose roll diameter distributions in the axial direction are expressed by quadratic functions (ordinary rolls whose crowns are not variable) may be used as a method of calculating the same direction shift amount $\delta_P$ that brings a wear dispersion effect.

For example, an excellent effect can also be obtained by the following simple method. In this method, a maximum value $\delta_P^{MAX}$, a minimum value $\delta_P^{MIN}$, a change amount $\delta_P^{STEP}$ per coil, and an initial value $\delta_P^0$ after roll replacement are given as constants in advance. When the roll replacement is performed, $\delta P=\delta_P^0$ is set, and subsequently $\delta_P$ is changed by $\delta_P^{STEP}$ every time one coil is rolled. When $\delta_P$ has reached $\delta_P^{MAX}$ or $\delta_P^{MIN}$, the sign of $\delta_P^{STEP}$ is reversed. This is continued until a next roll replacement.

Figure 9:
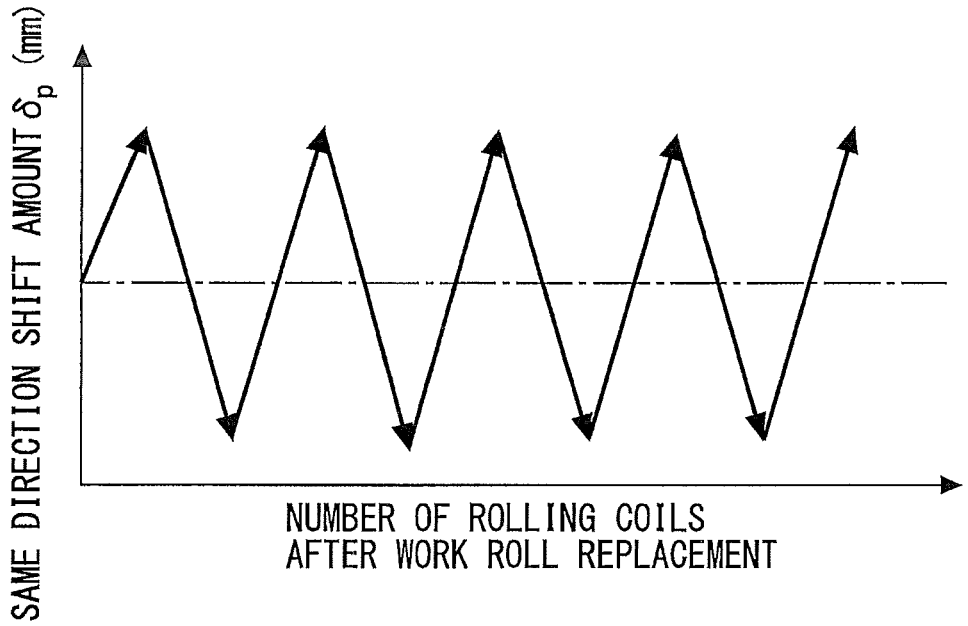
FIG. 9 is a diagram showing an example of a same direction shift pattern.

As a result, a same direction shift pattern having a triangular-wave shape as shown in FIG. 9 is set. A horizontal axis represents the number of rolling coils after the roll replacement, and it is equal to a maximum of about 50 to 100 coils for a roll of a normal material.

Figure 11:
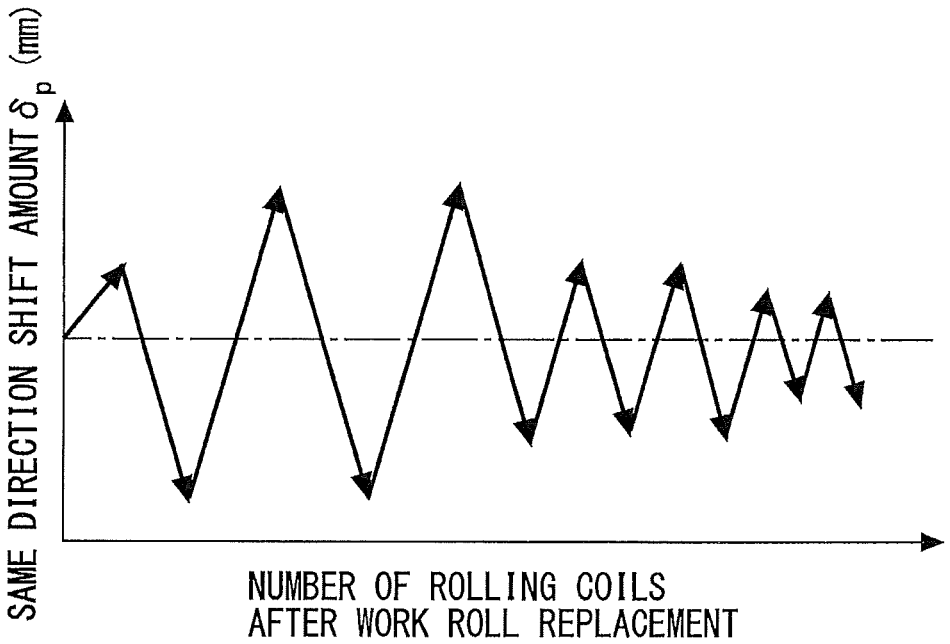
FIG. 11 is a diagram showing another example of the same direction shift pattern.

In the foregoing method, $\delta_P^{MAX}$, $\delta_P^{MIN}$, and $\delta_P^{STEP}$ may be changed according to the number of rolling coils after the roll replacement. For example, as a rolling plan, products are shifted from narrow products to wide products over first rolling coils of about ten, and subsequently, according to occurring wear, products are gradually shifted to narrow products for which shape control is easy. In such a case, a same direction shift pattern as shown in FIG. 11 is set.

Alternatively, the same direction shift amount may be changed for each rolling target material 20 so that the wear shapes of the pair of work rolls which are predicted based on a rolling plan for a plurality of rolling target materials 20 are made close to target wear shapes. Specifically, a target wear shape represented by a smooth curve is determined based on a rolling command received from the host computer in advance when roll replacement is performed or the like. When each rolling target material 20 is rolled, a same direction shift pattern is determined so that a wear actual value of a work roll of interest estimated from a rolling load actual value approaches to the target wear shape.

After $\delta_P$ is determined as described above, in step S120, the screw down position difference calculator 12*c* calculates, based on the same direction shift amount, a screw down position difference of the roll gap adjusting device which approaches the roll gap difference between both the edge portions in the width direction of the rolling target material 20 to zero. Specifically, the screw down position difference calculator 12*c* calculates the screw down position difference $\delta_S$ satisfying the following expression.

[Expression 15]

$$y(x)=y_0(x) \quad (15)$$

In other words, the expressions (12) and (13) are substituted into the expression (15), and $\delta_S$ is calculated by the following expression.

[Expression 16]

$$\delta_S=(-4\times C_2+12\times C_3\times\delta_C)\times L_{CYL}\times\delta_P \quad (16)$$

At this time, from the expressions (7), (8), and (10), the upper work roll shift amount $\delta_T$ and the lower work roll shift amount $\delta_B$ are expressed as follows.

[Expression 17]

$$\delta_T=\delta_C+\delta_P \quad (17)$$

[Expression 18]

$$\delta_B=-\delta_C+\delta_P \quad (18)$$

Note that the following expression is obtained by substituting the expression (14) into the expression (16).

[Expression 19]

$$\delta_S=-16\times C_{eq}\times L_{CYL}/(L_B^2)\times\delta_P \quad (19)$$

The case where the roll diameter distribution in the axial direction of the work roll can be expressed by a cubic expression has been described above, but the work roll having a roll diameter distribution represented by a curve similar to a cubic curve with a trigonometric function or a higher-order function may be used. In the rolling equipment configured to change the equivalent roll crown, $\delta_S$, $\delta_T$, and $\delta_B$ may be likewise calculated by using the expression (19) after the equivalent roll crown $C_{eq}$ per roll at the end position of the backup roll is likewise calculated.

Figure 10:
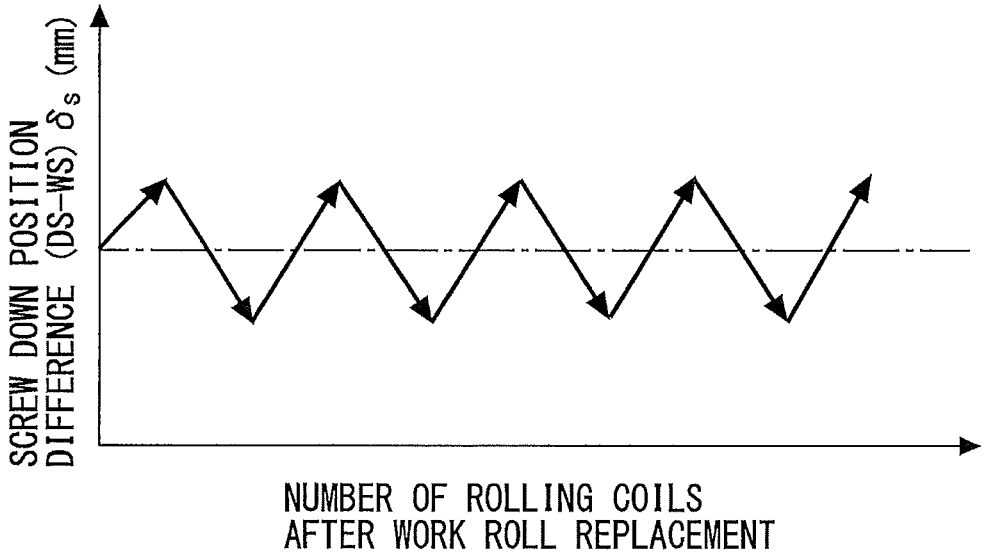
FIG. 10 is a diagram showing an example of a change pattern of a screw down position difference.
Figure 12:
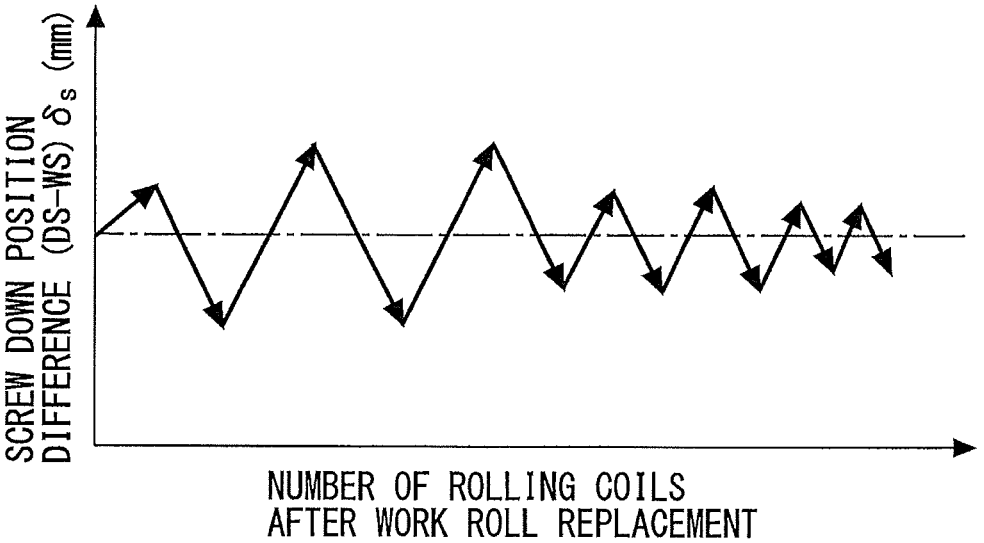
FIG. 12 is a diagram showing another example of the change pattern of the screw down position difference.

When the same direction shift is performed as shown in FIG. 9, the screw down position is changed as shown in FIG. 10 according to the expression (19). When the same direction shift is performed as shown in FIG. 11, the screw down position is changed as shown in FIG. 12 according to the expression (19).

Note that when the same direction shift is performed, the gap between the upper and lower work rolls at the center in the width direction of the rolling mill changes, so that it is necessary to simultaneously change the screw down positions on both the work side and the drive side as follows. The change amount $\delta_h$ of the screw down position (common to the work side and the drive side) is obtained by the following expression.

[Expression 20]

$$\delta_h=(D_{WT}(-\delta_P)-D_{wT}(0))+(D_{WB}(\delta_P)-D_{WB}(0)) \quad (20)$$

Accordingly, the screw down position change amount $\Delta S_{WS}$ of the work side and the screw down position change amount $\Delta S_{DS}$ of the drive side due to wear dispersion are obtained as follows.

[Expression 21]

$$\Delta S_{DS}=\delta_h-\delta_S/2 \quad (21)$$

[Expression 22]

$$\Delta S_{WS}=\delta_h+\delta_S/2 \quad (22)$$

Note that although depending on the roll curve and the same direction shift amount, $\delta_h$ is usually less than 10 micrometers, and thus corrections of the expressions (21) and (22) may be omitted according to required product accuracy.

As described above, $\delta_C$, $\delta_P$, and $\delta_S$ are calculated by the setting calculation in the process computer 12 so that y(x) is equivalent to $y_0(x)$. In step S130, the controller 13 causes the work roll shift devices (29T, 29B) to shift the upper work roll 21T and the lower work roll 21B respectively based on the total value of the opposite direction shift amount $\delta_C$ and the same direction shift amount $\delta_P$, and causes the roll gap adjusting devices (26WS, 26DS) to change the work-side screw down position and the drive-side screw down position based on the screw down position difference $\delta_S$.

As described above, according to a processing flow shown in FIG. 8, it is possible to offset the roll gap difference of both the edge portions in the width direction of the rolling target material that occurs when the opposite direction shift for obtaining a required equivalent roll crown and the same direction shift for wear dispersion are used in combination. Therefore, the wear of the work rolls can be dispersed while maintaining the equivalent roll crown.

(Hardware Configuration Example)

Figure 13:
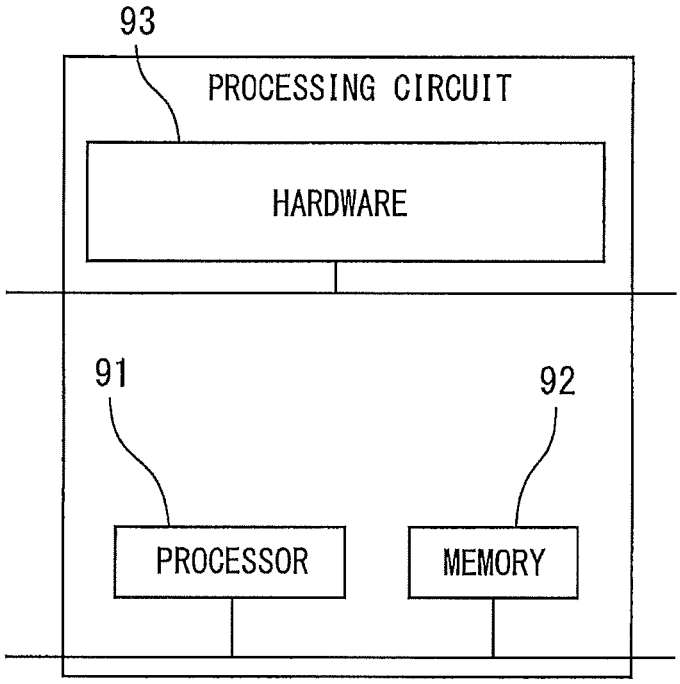
FIG. 13 is a conceptual diagram showing a hardware configuration example of a processing circuit equipped in a process computer.

FIG. 13 is a conceptual diagram showing a hardware configuration example of a processing circuit included in the process computer 12 described above. The opposite direction shift amount calculator 12*a*, the same direction shift amount calculator 12*b*, the screw down position difference calculator 12*c*, etc. described above represent some of the functions of the process computer 12, and each function is implemented by a processing circuit. As one aspect, the processing circuit includes at least one processor 91 and at least one memory 92. As another aspect, the processing circuit includes at least one dedicated hardware 93.

When the processing circuit includes the processor 91 and the memory 92, each function is implemented by software, firmware, or a combination of software and firmware. At least one of software and firmware is described in the form of a program. At least one of software and firmware is stored in the memory 92. The processor 91 implements each function by reading and executing the program stored in the memory 92.

When the processing circuit includes dedicated hardware 93, the processing circuit is, for example, a single circuit, a composite circuit, a programmed processor, or a combination thereof. Each function is implemented by a processing circuit.

Second Embodiment

Next, a second embodiment will be described. In the first embodiment described above, the screw down position difference $\delta_S$ required for control can be calculated by the expression (16) or (19) based on the same direction shift amount. However, in actual rolling, a restriction may be imposed on the screw down position difference. For example, when the screw down position difference is increased in the case of a small plate thickness, the edge portions in the width direction of the upper and lower curved rolls may come into contact with each other. Furthermore, when the lengths of the hydraulic cylinders of the roll gap adjusting devices (26WS, 26DS) are shortened to enhance responsiveness, the movable range of the hydraulic cylinder may be insufficient.

Therefore, in the second embodiment, in such a case, the wear of the work rolls is dispersed by changing both the same direction shift amount and the opposite direction shift amount. In other words, the same direction shift amount is reduced, and a part of the opposite direction shift amount is used as a transfer shift amount for wear dispersion of the pair of work rolls. At this time, the plate crown on the exit side of the rolling stand changes due to the change in the opposite direction shift amount for wear dispersion. Therefore, the work roll bender 30 is caused to change the bending force so as to offset the change amount of the plate crown caused by the transfer shift amount.

For example, a transfer coefficient 13 is introduced as follows, and β is changed according to the product dimension and the like.

[Expression 23]

$$\delta_P'=\beta\times\delta_P \quad (23)$$

[Expression 24]

$$\delta_C'=\delta_C+(1-\beta)\times\delta_P \quad (24)$$

Here, $\delta_P$ represents the same direction shift amount based on the expression (16) or (19), $\delta_P'$ represents the same direction shift amount after transfer, $\delta_C$ represents the shift amount when no wear dispersion is performed, and $\delta_C'$ represents the opposite direction shift amount after transfer.

At this time, the bending force is corrected as follows.

First, the expression (3) is modified as follows to calculate the change $\Delta C_{eq}$ of the equivalent roll crown of the rolling stand of interest due to transfer to the opposite direction shift amount.

[Expression 25]

$$\Delta C_{eq}(\delta C'-\delta_C-k_A)/k_B \quad (25)$$

From the expression (1), the bender correction amount for offsetting the change of the roll crown of the rolling stand of interest is expressed as follows. By using this, the bending force of the rolling stand of interest is corrected.

[Expression 26]

$$F_B' = F_B - k_3/k_4 \times \Delta C_{eq} \quad (26)$$

Here, $F_B$ represents bending force when no wear dispersion is performed, and $F_B'$ represents bending force after transfer.

Note that when the shift amount or the bending force exceeds a permissible range even by this transfer processing, the calculation of the expressions (23) to (26) is performed again after $\delta_P$ in the expression (23) is reduced.

For example, when the shift amount of the upper roll exceeds the upper limit of the mechanical shift amount, the correction is performed as follows.

[Expression 27]

$$\delta_P = \delta_P^0 + (\delta_T^{MAX} + \delta_T^0)/2 \quad (27)$$

Here, $\delta_P^0$ represents a same direction shift amount before the correction, $\delta_P$ is a same direction shift amount after the correction, $\delta_T^0$ represents an upper work roll shift amount before the correction, and $\delta_T^{MAX}$ represents the upper limit of a mechanical upper work roll shift amount.

The embodiments of the present invention have been described above. The present invention is not limited to the above-described embodiments, and various modifications can be made without departing from the subject matter of the present invention.

REFERENCE SIGNS LIST

1 Rolling equipment
2 Heating furnace
3 Rough rolling mill
4 Finishing rolling mill
5 Runout table
6 Coiler
7 Roller table
10 Control equipment
11 Host computer
12 Process computer
12*a* Opposite direction shift amount calculator
12*b* Same direction shift amount calculator
12*c* Screw down position difference calculator
13 Controller
20 Rolling target material
21T, 21B Upper work roll, lower work roll
22T, 22B Upper backup roll, lower backup roll
23T, 23B Upper spindle, lower spindle
24T, 24B Upper work roll chock, lower work roll chock
25T, 25B Upper backup roll chock, lower backup roll chock
26WS, 26DS Work-side roll gap adjusting device, drive-side roll gap adjusting device
27WS, 27DS Work-side load cell, drive-side load cell
28WS, 28DS Work-side position detector, drive-side position detector
29T, 29B Upper work roll shift device, lower work roll shift device
30 Work roll bender
41 to 47 Rolling stand
81 to 84 Sensor
91 Processor
92 Memory
93 Hardware
$\delta_C$ Opposite direction shift amount
$\delta_P$ Same direction shift amount
$\delta_S$ Screw down position difference

The invention claimed is:

1. A roll wear dispersion method for a rolling stand that rolls a rolling target material, wherein the rolling stand comprises:

a pair of work rolls including an upper work roll and a lower work roll in which roll diameter distributions thereof in an axial direction are expressed by cubic or higher-order polynomials, wherein the upper work roll and the lower work roll are opposed to each other;

a work roll shifter configured to shift each of the upper work roll and the lower work roll in the axial direction; and a roll gap adjuster configured to change a work-side roll gap and a drive-side roll gap of the pair of work rolls by changing a work-side screw down position and a drive-side screw down position, and wherein the roll wear dispersion method comprises:

calculating an opposite direction shift amount for the upper work roll and the lower work roll such that a plate crown and flatness of the rolling target material on an exit side of the rolling stand are within predetermined ranges;

calculating a same direction shift amount for the upper work roll and the lower work roll that disperses wear of the pair of work rolls;

based on the same direction shift amount, calculating a screw down position difference of the roll gap adjuster that makes a roll gap difference between both edge portions in a width direction of the rolling target material close to zero; and causing the work roll shifter to shift each of the upper work roll and the lower work roll based on a total value of the opposite direction shift amount and the same direction shift amount, and causing the roll gap adjuster to change the work-side screw down position and the drive-side screw down position based on the screw down position difference.

2. The roll wear dispersion method for the rolling stand according to claim 1, wherein the screw down position difference is calculated from a following expression including the same direction shift amount;

$\delta_S = -16 \times C_{eq} \times L_{CYL}/(L_B^2) \times \delta_P$, wherein $\delta_s$ represents the screw down position difference, $C_{eq}$ represents an equivalent roll crown, $L_{CYL}$ represents an interval between action points of the work-side screw down position and the drive-side screw down position, $L_B$ represents a trunk length of a backup roll, and $\delta_P$ represents the same direction shift amount.

3. The roll wear dispersion method for rolling stand according to claim 1, wherein the rolling stand further comprises a work roll bender configured to apply a bending force to both shaft ends of the pair of work rolls, and further comprising:

using a part of the opposite direction shift amount as a transfer shift amount for wear dispersion of the pair of work rolls; and causing the work roll bender to change the bending force so as to offset a change amount of the plate crown caused by the transfer shift amount.

4. The roll wear dispersion method for the rolling stand according to claim 1, further comprising:

changing the same direction shift amount for each of a plurality of the rolling target materials so that wear shapes of the pair of work rolls predicted based on a rolling plan for the plurality of the rolling target materials are made close to target wear shapes.

5. A rolling system for rolling a rolling target material comprising:

a pair of work rolls including an upper work roll and a lower work roll in which roll diameter distributions thereof in an axial direction are expressed by cubic or higher-order polynomials, wherein the upper work roll and the lower work roll are opposed to each other;

a work roll shifter configured to shift each of the upper work roll and the lower work roll in the axial direction:

a roll gap adjuster configured to change a work-side roll gap and a drive side roll gap of the pair of work rolls by changing a work-side screw down position and a drive-side screw down position:

a computer configured to:

calculate an opposite direction shift amount for the upper work roll and the lower work roll such that a plate crown and flatness of the rolling target material on an exit side of the pair of work rolls g within predetermined ranges:

calculate a same direction shift amount for the upper work roll and the lower work roll that disperses wear of the pair of work rolls;

calculate, based on the same direction shift amount, a screw down position difference of the roll gap adjuster that makes a roll gap difference between both edge portions in a width direction of the rolling target material close to zero; and cause the work roll shifter to shift each of the upper work roll and the lower work roll based on a total value of the opposite direction shift amount and the same direction shift amount, and causing the roll gap adjuster to change the work-side screw down position and the drive-side screw down position based on the screw down position difference.

6. The rolling system according to claim 5, wherein the screw down position difference is calculated from a following expression including the same direction shift amount: $\delta_S=-16\times C_{eq}\times L_{CYL}/(L_B^2)\times\delta_P$, wherein $\delta_s$ represents the screw down position difference, $C_{eq}$ represents an equivalent roll crown, $L_{CYL}$ represents an interval between action points of the work-side screw down position and the drive-side screw down position, $L_B$ represents a trunk length of a backup roll, and $\delta_P$ represents the same direction shift amount.

7. The rolling system according to claim 5, further comprising a work roll bender configured to apply a bending force to both shaft ends of the pair of work rolls, the computer further configured to;

use a part of the opposite direction shift amount as a transfer shift amount for wear dispersion of the pair of work rolls, and cause the work roll bender to change the bending force so as to offset a change amount of the plate crown caused by the transfer shift amount.

8. The rolling system according to claim 5, wherein the same direction shift amount is changed for each of a plurality of the rolling target materials so that wear shapes of the pair of work rolls predicted based on a rolling plan for the plurality of the rolling target materials are made close to target wear shapes.

* * * * *